US008957296B2

(12) United States Patent
Helms et al.

(10) Patent No.: US 8,957,296 B2
(45) Date of Patent: Feb. 17, 2015

(54) CHORD TRAINING AND ASSESSMENT SYSTEMS

(75) Inventors: Jan-Hinnerk Helms, Hamburg (DE); Greg Gilley, Los Altos, CA (US); Gerhard Lengeling, Los Altos Hills, CA (US)

(73) Assignee: Apple Inc., Cupertino, CA (US)

( * ) Notice: Subject to any disclaimer, the term of this patent is extended or adjusted under 35 U.S.C. 154(b) by 67 days.

(21) Appl. No.: 12/757,938

(22) Filed: Apr. 9, 2010

(65) Prior Publication Data

US 2011/0247479 A1 Oct. 13, 2011

(51) Int. Cl.
*G10H 1/38* (2006.01)
*G10H 1/00* (2006.01)

(52) U.S. Cl.
CPC ..... *G10H 1/383* (2013.01); *G10H 1/0016* (2013.01); *G10H 2210/091* (2013.01)
USPC ..... 84/613; 84/609; 84/637; 84/649; 84/650; 84/669; 84/470 R; 84/477 R; 84/483.2; 84/485 R

(58) Field of Classification Search
CPC ... G06F 3/016; G06F 3/0233; G06F 15/0225; G06F 1/1637; G06F 3/04895; G06F 3/04897; G10H 2220/015; G10H 2210/066; G10H 2220/135; G10H 2210/091; G10H 2220/056; G10H 2220/076; G10H 1/383; G10H 2220/101; G10H 2220/126; G10H 2220/026
See application file for complete search history.

(56) References Cited

U.S. PATENT DOCUMENTS

| | | | | |
|---|---|---|---|---|
| 4,428,269 | A | 1/1984 | Bione et al. | |
| 5,440,756 | A | 8/1995 | Larson | |
| 5,644,096 | A * | 7/1997 | Bull | 84/485 SR |
| 5,973,252 | A * | 10/1999 | Hildebrand | 84/603 |
| 6,504,090 | B2 | 1/2003 | Tsai et al. | |
| 7,241,945 | B1 * | 7/2007 | Egan | 84/483.2 |
| 7,423,214 | B2 * | 9/2008 | Reynolds et al. | 84/612 |
| 7,521,619 | B2 * | 4/2009 | Salter | 84/477 R |
| 7,626,109 | B2 * | 12/2009 | Katou | 84/477 R |
| 7,893,337 | B2 * | 2/2011 | Lenz | 84/477 R |
| 8,269,094 | B2 * | 9/2012 | Buskies et al. | 84/613 |
| 8,338,684 | B2 * | 12/2012 | Pillhofer et al. | 84/470 R |
| 8,629,342 | B2 * | 1/2014 | Lee et al. | 84/610 |
| 2001/0045153 | A1 * | 11/2001 | Alexander et al. | 84/609 |
| 2002/0029681 | A1 | 3/2002 | Manning | |
| 2005/0126368 | A1 | 6/2005 | Harrison | |
| 2006/0032362 | A1 * | 2/2006 | Reynolds et al. | 84/601 |
| 2006/0107826 | A1 * | 5/2006 | Knapp et al. | 84/724 |
| 2007/0089590 | A1 * | 4/2007 | Katou | 84/609 |
| 2008/0223202 | A1 * | 9/2008 | Shi | 84/645 |
| 2008/0264241 | A1 * | 10/2008 | Lemons | 84/601 |
| 2008/0282872 | A1 * | 11/2008 | Ma et al. | 84/627 |

(Continued)

OTHER PUBLICATIONS

"Chords!—Guitar Chords and Tabs in Winamp," CBMS Networks, Inc., Palo Alto, California (Available online at http://chords.fm/Chords!/, last visited Apr. 9, 2010).

*Primary Examiner* — Marlon Fletcher

(74) *Attorney, Agent, or Firm* — Fish & Richardson P.C.

(57) ABSTRACT

The invention relates to systems, methods, and apparatus for assessing a musical performance of a chord, a chord series, or a chord progression. The performance can include a user's performance of a musical instrument. MIDI or audio notes are input and compared to the notes of music track. An indication can be provided to assess the performance. The assessment can be on the basis of timing and/or pitch errors. A new chord can be displayed to a user based on the assessment of the user's performance of the previous chord.

16 Claims, 10 Drawing Sheets

(56) References Cited

U.S. PATENT DOCUMENTS

| | | | | |
|---|---|---|---|---|
| 2010/0137049 | A1* | 6/2010 | Epstein | 463/7 |
| 2010/0154619 | A1* | 6/2010 | Taub et al. | 84/616 |
| 2010/0304863 | A1* | 12/2010 | Applewhite et al. | 463/36 |
| 2010/0313736 | A1* | 12/2010 | Lenz | 84/477 R |
| 2011/0011241 | A1* | 1/2011 | Bartos | 84/485 R |
| 2011/0011246 | A1* | 1/2011 | Buskies et al. | 84/613 |
| 2011/0207513 | A1* | 8/2011 | Cross et al. | 463/7 |
| 2011/0247479 | A1* | 10/2011 | Helms et al. | 84/613 |
| 2011/0259176 | A1* | 10/2011 | Pillhofer et al. | 84/470 R |
| 2012/0165087 | A1* | 6/2012 | Epstein | 463/7 |
| 2013/0205977 | A1* | 8/2013 | Buskies et al. | 84/613 |
| 2013/0233152 | A1* | 9/2013 | Pillhofer et al. | 84/470 R |
| 2014/0100010 | A1* | 4/2014 | Lee et al. | 463/7 |

* cited by examiner

CHORD TRAINING AND ASSESSMENT SYSTEMS

FIELD

The following relates to computer systems, and more particularly to systems, methods, and apparatus for assessing the performance of one or more chords.

BACKGROUND

A chord can be any grouping of one or more musical notes, in particular any set of harmonically-related notes. The notes of a chord can be sounded simultaneously. Learning to play chords can be an important element of learning to play a musical instrument.

A chord progression can be a series of musical chords, or chord changes that establishes or contradicts a tonality founded on a key, root or tonic chord. A chord progression can be thought of as a harmonic simultaneity succession. In a chord progression, a change of chord generally occurs on an accented beat, so that chord progressions may contribute significantly to the rhythm, meter and musical form of a piece, delineating bars, phrases and sections. Thus, by learning to play a chord progression, a musician can learn to perform an entire song.

Learning to play chords and chord progressions can be faster and easier when assessment is provided. A music instructor typically observes a student perform a piece of music and provides assessment. The instructor can provide assessment as the student performs or after the student finishes performing. The instructor can help the student recognize errors. The instructor can provide feedback as to how to correct the errors. The instructor can also help the student track improvement over time.

Hiring a qualified music instructor can be expensive. Moreover, a music instructor is rarely available for each and every practice session. The student is typically left to practice alone, without any form of assessment. Practicing without assessment can result in the development of bad habits.

A need exists, therefore, for systems, methods, and apparatus for assessing the performance of one or more chords.

SUMMARY

Various embodiments compare a user's performance of a chord or series of chords to a music track or to a known chord, chord series, or chord progression, and provide real-time and offline assessment of the user's performance. The user's performance can be input as a MIDI signal or as an audio signal. A MIDI signal can be compared directly to a stored musical track, chord, chord series, or chord progression. An audio signal is first analyzed and then compared with a musical track, chord, chord series, or chord progression.

Pitch errors can be detected during the comparison. If the user's performance is being compared to a chord progression, timing errors can be displayed instead of or in addition to pitch errors. The results of the comparison can be displayed to the user in a variety of ways.

Some embodiments allow a series of chords to be practiced. The series of chords can be selected on any basis, for example, key, difficulty level, or a customized rating. A customized rating for a chord can be entered by the user or can be generated automatically based on a user's success at performing the chord in the past. One or more chords from a series of chords can be displayed. The display can advance to the next chord at a set pace, after each input, or based on the comparison between the user's performance and the stored music track or chord. For example, the next chord can be displayed only when the user plays the current chord correctly.

Many other aspects and examples will become apparent from the following disclosure.

BRIEF DESCRIPTION OF THE DRAWINGS

In order to further explain/describe various aspects, examples, and inventive embodiments, the following figures are provided.

Figure 1:
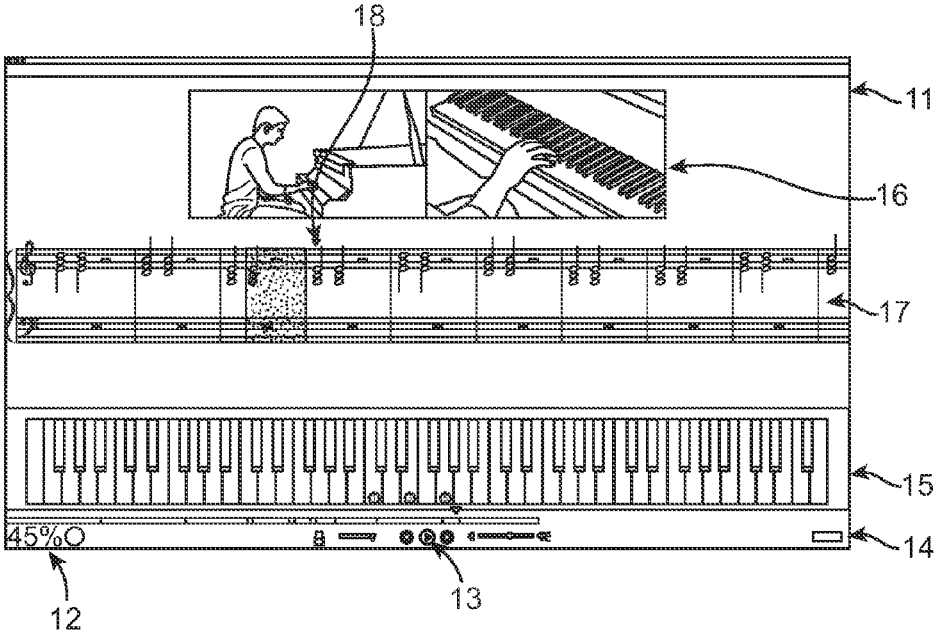
FIG. 1 depicts a schematic view of an assessment user interface.

It should be understood that the various embodiments are not limited to the arrangements and instrumentality shown in the drawings.

DETAILED DESCRIPTION

The functions described as being performed at various components can be performed at other components, and the various components can be combined and/or separated. Other modifications can also be made.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure. Numerical ranges include all values within the range. For example, a range of from 1 to 10 supports, discloses, and includes the range of from 5 to 9. Similarly, a range of at least 10 supports, discloses, and includes the range of at least 15.

Thus, the following disclosure describes systems, methods, and apparatus for assessing musical performance. Many other examples and other characteristics will become apparent from the following description.

Offering assessment helps a user learn to play a musical instrument. According to various embodiments, systems, methods, and apparatus provide assessment of a musical performance. The systems, methods, and apparatus can be incorporated into digital audio workstations. The user can be provided with an option to choose whether to be assessed. If the user chooses to be assessed, the user's performance can be received, analyzed, and compared with a music track or a musical score. The results of the comparison can be presented in real-time and offline.

One embodiment can include a chord trainer user interface to help users learn and rehearse chords. The chord trainer user interface can include chords for any instrument, including guitar chords and piano chords. The chord trainer user interface can include a selection of chords that were part of a previously active lesson. Chords from a lesson can be stored in system memory and retrieved as needed to be displayed in the chord trainer user interface. Chords can also be selected from a chord library containing a variety of chords, for example, a library of guitar chord grids. Chords can be selected from the chord library by default.

A user's performance can be received in various ways. MIDI (Musical Instrument Digital Interface) is an industry-standard protocol defined in 1982 that enables electronic musical instruments such as keyboard controllers, computers, and other electronic equipment to communicate, control, and synchronize with each other. An incoming MIDI signal can be directly compared to a chord, chord series, or chord progression and/or to a musical track; no further analysis of the incoming MIDI signal is necessary. Incoming audio signals, for example, signals from a microphone or a musical instrument, need to be analyzed in order to be compared to a chord, chord series, or chord progression or to a musical track. Both monophonic and polyphonic signals can be analyzed.

The system can detect individual notes in a polyphonic signal by any method of analysis known to those in the art. For example, the system can convert the polyphonic signal from a time domain to a frequency domain. The system can then analyze fundamental frequency peaks and a set number of related harmonic partial peaks, for each fundamental frequency peak, to determine individuals notes that within the polyphonic signal.

The comparison of the user's performance to the musical track, chord, chord series, or chord progression can include an evaluation of both pitch and timing. As soon as there is a deviation in either pitch or timing or both, the relevant chord is considered to be an error. Based on the total number of errors played and the total number of chords in the lesson, song, chord series, or chord progression, a percentage value of correct chords can be generated. A percentage of pitch errors and a percentage of timing errors can also be determined separately. For example, by only counting pitch errors and relating the number of pitch errors to the total number of chords in the lesson, song, chord series, or chord progression.

The musical track, chord, chord series, or chord progression to which a user's performance can be compared can be stored in system memory. The chord, chord series, or chord progression can be for any instrument. Existing tracks can be used, for example, a full piano score track can be used, or a guitar tablature can be used. A dedicated track can also be used to hold reference data specifically designed for assessment.

In some situations it can be desirable not to assess certain chords, chord series, or chord progressions of a lesson. When a particular chord, chord series, or chord progression is not to be assessed, the assessment can pause. At least three situations exist where certain chords, chord series, or chord progressions of a lesson should not be assessed. First, a real solo may exist within a lesson. A real solo is a passage that can be specifically labeled within a chord series, chord progression, song, or lesson. A real solo is a passage that can be freely played by the user. A real solo is often of a relatively long duration in comparison to other passages of a chord series, chord progression, song, or lesson. During a real solo, assessment can be paused. Second, an optional solo may exist within a chord series, chord progression, song, or lesson. An optional solo can be specifically labeled. An optional solo is a passage where a user has the option to move away from a chord series, chord progression, song, or lesson and play his or her own interpretation. During an optional solo, assessment can be paused. Finally, small data deviations between a chord, chord series, or chord progression and a teacher audio track may occur, wherein the chord, chord series, or chord progression and the teacher audio track do not match. During such data deviations assessment can be paused. Information about these exceptions can be stored separately from the lesson. For new lessons, the exceptions can be authored in the lesson directly.

As discussed below, various user interface features can be employed. For example, a user interface element can display the user's performance over the course of a song. A real-time display of the user's performance can be provided. A user interface element can be provided to trigger an assessment results/history view.

Referring to FIG. 1, a schematic view of a chord training and assessment user interface 11 is illustrated. Chord training and assessment user interface 11 can include one or more of the following user interface elements: a rating region 12, a control region 13, a chord lane region 14, an instrument region 15, a movie region 16, a chord display region 17, and a playhead 18. Each user interface element will be described in the context of other Figures.

Figure 2:
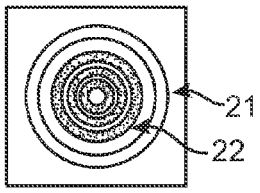
FIG. 2 depicts a schematic view of a recent performance rating.

Referring to FIG. 2, a schematic view of a recent performance rating 21 is illustrated. Recent performance rating 21 can be one element of rating region 12. Recent performance rating 21 can include a graphical depiction 22. Graphical depiction 22 can be a circle graphic including a series of concentric bands of one or more colors. The recent performance rating 21 can provide an assessment of a number of chords of a chord series, chord progression, song, or lesson recently played. For example, in one embodiment the recent performance rating 21 can provide an assessment of the last four chords played. The recent performance rating 21 can indicate the number of correct chords in relation to the total number of chords assessed. For example, the recent performance rating 21 can indicate the number of correct chords in relation to the last four chords played. The recent performance rating 21 can indicate the number of correct chords in relation to the total number of chords within the number of chords assessed as a fractional or percentage value. The fractional or percentage value can be displayed graphically as graphical depiction 22. When graphical depiction 22 takes the form of a circle graphic, including one or more concentric bands, colored bands can indicate the percentage value of correctly played chords. The bands can be colored any color, for example green. Thus, in one embodiment, the more bands that are colored green, the higher the percentage value of correctly played chords. At the conclusion of a chord series, chord progression, song, or lesson, when the user ends play back, or at anytime when the system is not in a recording state, the graphical depictions can be replaced by a percentage value or a graphical ranking. For example, a series of stars, representing the average recent performance rating can be displayed.

Figure 3:
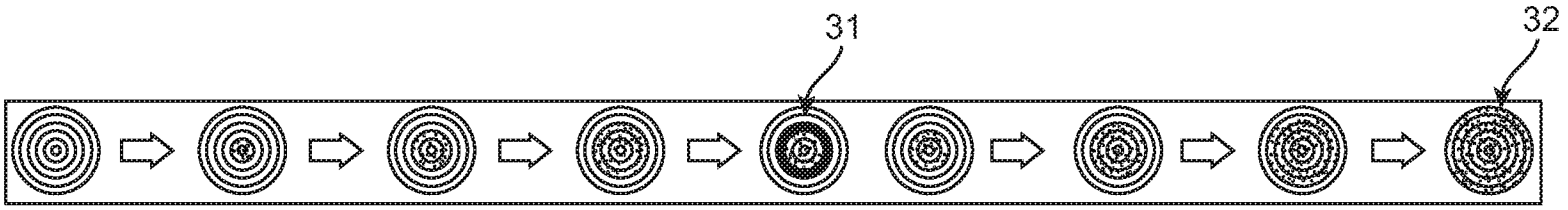
FIG. 3 depicts a series of nine recent performance ratings.

Referring to FIG. 3, a series of nine recent performance ratings 21 is shown. Each of the nine recent performance ratings 21 shows a different state of the graphical depiction 22. In other words, only one graphical depiction 22 is shown at a time, and FIG. 3 illustrates changes to the graphical depiction 22 over time. Moving from left to right in FIG. 3, more concentric bands are colored, indicating a higher percentage of correctly played chords. One graphical depiction 22 shows a highlighted outer concentric band 31 to illustrate that if the user plays a wrong chord, the outer band can flash red and then disappear. If the user plays all the chords in the assessed chord series, chord progression, song, or lesson correctly, all concentric bands can be colored as shown in fully colored graphical depiction 32.

Figure 4:
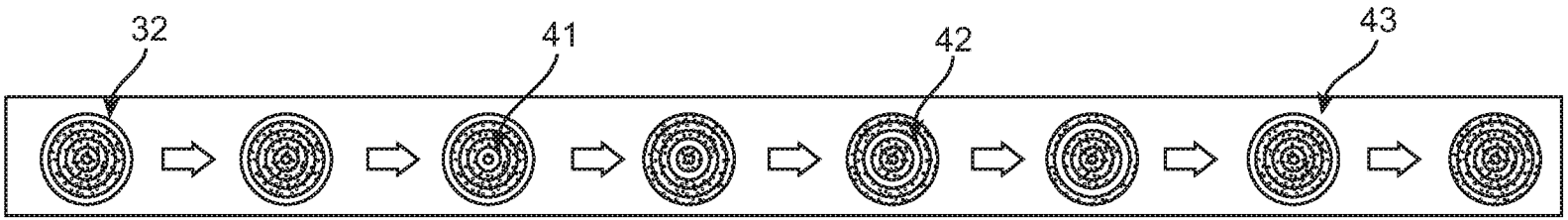
FIG. 4 depicts a series of eight fully colored graphical depictions.

Referring to FIG. 4, a series of eight fully colored graphical depictions 32 is shown. Only one graphical depiction 32 is shown at a time, and FIG. 4 illustrates changes to the graphical depiction 32 over time. When all bands of the graphical depiction are colored, an additional animation can indicate the beats of a currently played chord series, chord progression, lesson, or song. The green rings can be highlighted from inner to outer ring with the highlight reaching the outer ring at the end of the beat. For example, at the beginning of a beat, first ring 41 can be highlighted. Half-way through the beat, middle ring 42 can be highlighted. At the end of the beat, outer ring 43 can be highlighted. The animation can create a pleasing visual pulse that can help the user keep to the beat, and provide a reward to the user for maintaining a high percentage of correctly played chords. When all bands of the graphical depiction 32 are colored, an additional animation can indicate a beat, prompting the user to play the chord. After switching to a new chord the graphical depiction 32 can be fully highlighted, thereafter, the graphical depiction 32 can be emptied gradually. If the user plays the chord correctly, the graphical depiction 32 can be frozen for a short interval. Then with the next chord, the graphical depiction 32 can be filled again.

Figure 5:
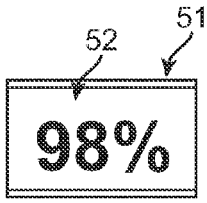
FIG. 5 depicts a schematic view of an overall performance rating.

Referring to FIG. 5, a schematic view of an overall performance rating 51 is shown. Overall performance rating 51 can be one element of rating region 12. Overall performance rating 51 can display the overall performance so far in a given score. Rating 51 can compare chords played correctly against the total number of chords in the part of the lesson played so far. Rating 51 can be displayed as a percentage read-out 52. The appearance, for example, the color, of overall performance rating 51 can be changed depending on the direction of change of the percentage value. For example, if the percentage value of rating 51 increases or stays the same, rating 51 and/or percentage read-out 52 can be shaded green. On the other hand, if the percentage value of rating 51 decreases, rating 51 and/or percentage read-out 52 can be shaded red.

Figure 6:
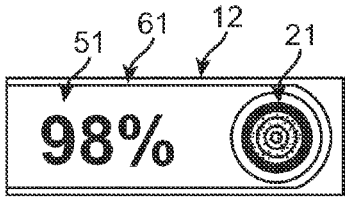
FIG. 6 depicts a schematic view of a rating region.

Referring to FIG. 6, a schematic view of rating region 12 is shown. Rating region 12 includes an overall performance rating 51 and a recent performance rating 21. Rating region 12 can be positioned in the lower strip of the main assessment user interface. The combination of overall performance rating 51 and recent performance rating 21 can be referred to as the power meter 61.

Figure 7:
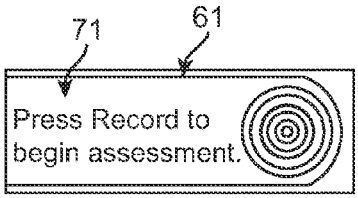
FIG. 7 depicts a schematic view of a power meter.

Referring to FIG. 7, power meter 61 can be replaced with an explanatory text 71, when no assessment has been done. A lesson can be divided into a number of chapters. For example, an instruction chapter, a demonstration chapter, and a play chapter. Display of power meter 61 can be limited to a play chapter of the current lesson. When the power meter 61 is not displayed, explanatory text 71 can be displayed.

Figure 8:
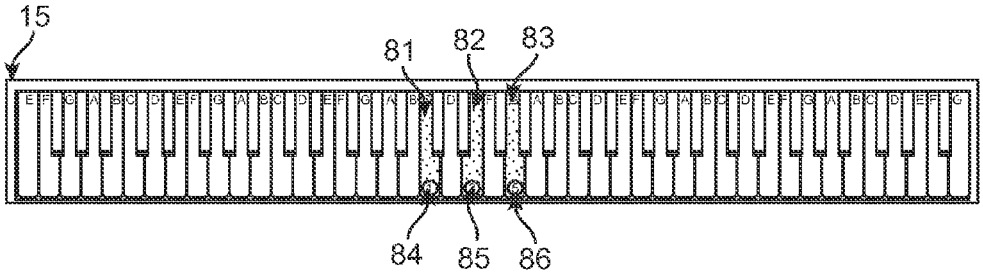
FIG. 8 depicts a schematic view of an instrument region.

Referring to FIG. 8, a schematic view of an instrument region 15 is shown. Instrument region 15 can include a graphical depiction of all or a portion of a musical instrument, such as a piano keyboard. In embodiments of the invention, where instrument region 15 depicts a piano keyboard, keys can be highlighted to designate a chord to be played. For example, first highlighted key 81, second highlighted key 82, and third highlighted key 83 can be highlighted to indicate the keys on the piano keyboard that correspond to a particular chord. Keys can be highlighted in real-time as the music track or score progresses. Fingering indicators can also be positioned on or near the keys. For example, first fingering indicator 84, second fingering indicator 85, and third fingering indicator 86 can be positioned on or near the keys to be played. The fingering indicators can include alphanumerical or symbolic designations, which indicate which finger should be used to play a particular key. For example, the number 1 can be used to indicate the thumb; the number 2 can be used to indicate the index finger; the number 3 can be used to indicate the middle finger; the number 4 can be used to indicate the ring finger; and the number 5 can be used to indicate the pinkie.

Figure 9:
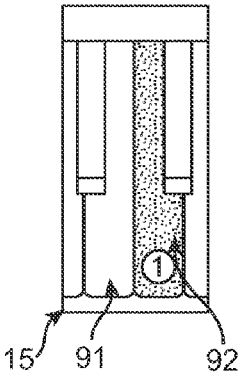
FIG. 9 depicts a schematic view of a portion of an instrument region.

Referring to FIG. 9, a portion of an instrument region 15 is shown. In embodiments where instrument region 15 depicts a piano keyboard, the key corresponding to the key actually played by the user can be depicted with an animation of a depressed key 91. The animation of a depressed key 91 can be shown for incorrect notes only or for both correct notes and incorrect notes. When a user plays an incorrect key, visual feedback can be provided by shading the correct key 92. The correct key can be shaded in any color, for example, red to indicate that an error occurred. Pitch errors and timing errors can be shown on the keyboard. In some embodiments, only pitch errors are shown.

Figure 10:
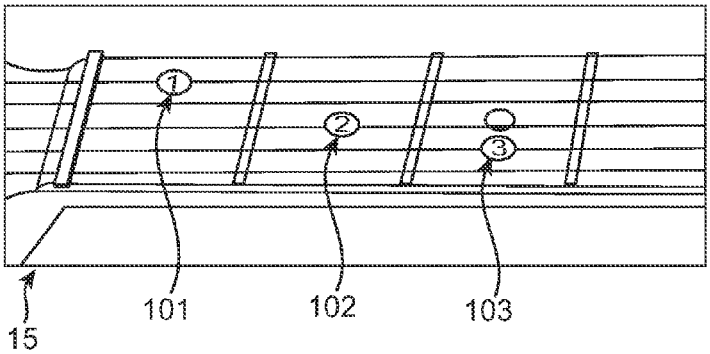
FIG. 10 depicts a schematic view of an instrument region.

Referring to FIG. 10, a schematic view of an instrument region 15 is shown. The instrument region 15 can depict a guitar fretboard. Fingering indicators can be displayed on the guitar fretboard to show the fingering position for individual notes or for chords. For example, first fingering indicator 101, second fingering indicator 102, and third fingering indicator 103 can be displayed on the guitar fredboard. Alphanumerical or symbolic designations can be positioned on or near the fingering indicators to indicate which fingers a user should use to depress the strings. For example, the number 1 can be used to indicate the index finger; the number 2 can be used to indicate the middle finger; the number 3 can be used to indicate the ring finger; and the number 4 can be used to indicate the pinkie. Visual feedback can be provided in respose to errors. The visual feedback can be displayed on the fretboard for whole chords or for single notes. For example, if any portion of a chord is played incorrectly, the chord can be shaded red, indicating that the chord was played incorrectly. Visual feedback can also be displayed on the fretboard if a portion of a chord is played incorrectly. For example, an indicator can be displayed on the fretboard, showing the fingering actually played and the correct fingering indicator can be shaded in a different color.

Figure 11:
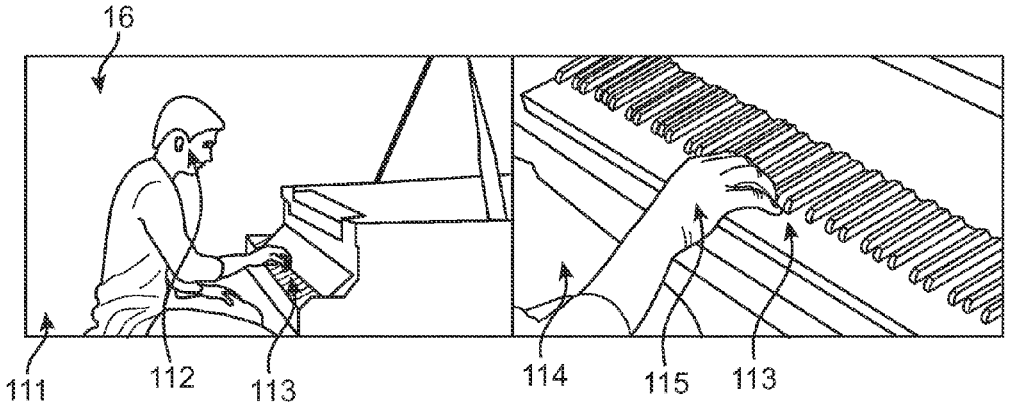
FIG. 11 depicts a schematic view of a movie region.

Referring to FIG. 11, a schematic view of a movie region 16 is shown. Movie region 16 can include one or more views. For example, movie region 16 can include a wide-angle view 111 and a close-up view 114. Wide-angle view can include a video, animation, or representation of a demonstrator 112 playing an instrument 113. The close-up view can include a closer view of the demonstrator's hands 115 interacting with the instrument 113. The demonstrator can play the instrument in sync with the music track, chord progression, song, or lesson so that the user can play along with the demonstrator.

As described above, assessment results can include a percentage value of correct chords. The percentage value of correct chords can be based on the total number of errors played and the total number of chords in a chord series, chord progression, song, or lesson. A percentage of pitch errors and a percentage of timing errors can also be determined separately. Each time a user plays a song, a part of a song or parts of a song, assessment results can be stored as an entry in a history database. If the user played only a part of a chord series, chord progression, song, or lesson, assessment results can be based on the song parts actually played. For example, even if the user only played a verse and a chorus of the lesson, assessment results, for example, percentage values, can be stored and used in a statistic.

A recording of the user's performance can be stored on a separate track. Existing recordings of user performances can be overwritten by new recordings. At every spot in the lesson, the latest performance of the user can be played back. In other words, the recording can be limited to a single "take" or performance of the entire lesson. Portions of the lesson not performed by the user can be excluded from playback. Recordings of past assessment attempts can be discarded or overwritten.

Embodiments include various systems, methods, and apparatus for reviewing and practicing a lesson. Upon completion of a lesson, or when the user ends a lesson prior to completing the entire lesson, assessment results can be displayed. Chord lane region 14, as illustrated in FIG. 1, can remain on screen when results are displayed.

Figure 12:
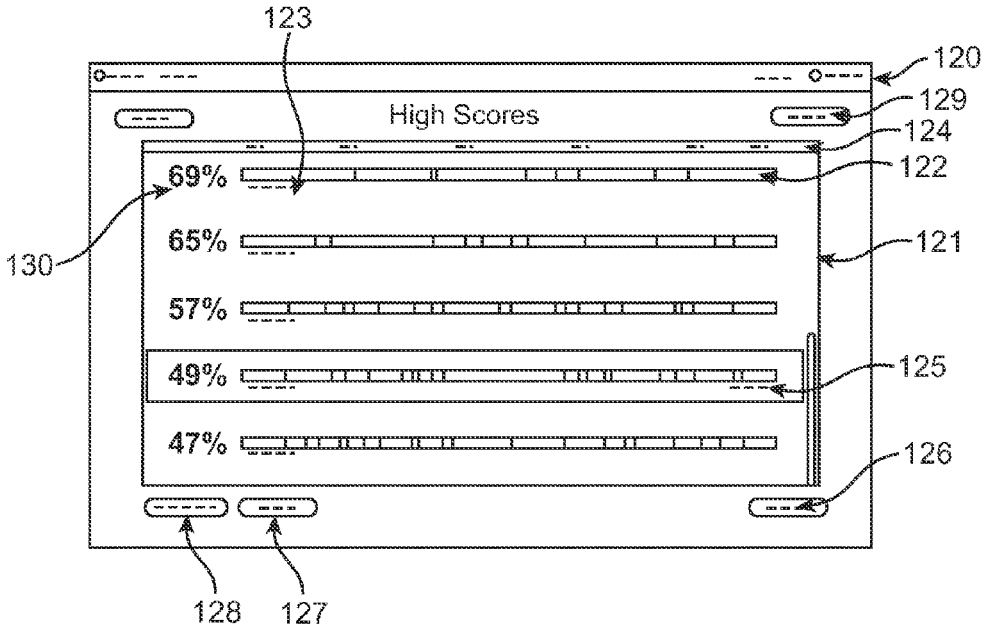
FIG. 12 depicts a schematic view of a user interface including an assessment results view.

Referring to FIG. 12, an additional user interface can be provided to enable users to review stored assessment attempts. The user interface can include an assessment results view 120. The assessment results view 120 can include a list 121 showing a number of assessment attempts for a particular lesson, track, chord series, chord progression, or song. For example, the list 121 can include the top five assessment attempts sorted by percentage result value 130. In addition to a percentage result value 130, each assessment attempt can include a condensed chord assessment strip 122, which can graphically display portions of a lesson in which pitch or timing errors occurred. To assist the user in determining where the timing and pitch errors, displayed in assessment strip 122, occurred within the song, list 121 can include a song part bar 124. Song part bar 124 can include score segments representing sections of a chord list or progression, for example, introduction, verse, chorus, bridge, and/or refrain. Song part bar 124 can have a length proportional to the duration of the entire song and each score segment can have a length proportional to the duration of the section of the song it represents. Each assessment attempt can also include a date and time stamp 123, displaying the date and/or the time on which the assessment attempt was started and/or finished. A functionality can be provided whereby, when a user double-clicks an assessment attempt entry the list 121 switches back to the main assessment interface 11 and displays the results for the assessment entry, or a full-page view of the notation can be displayed for the assessment attempt. A review lesson button 125 can be shown, for example on the right of the currently selected assessment attempt in list 121. Clicking the review lesson button 125 can have the same effect as double-clicking an assessment attempt entry. Assessment results view 120 can also include a play again button 126, which, when clicked, lets the user switch back to the main assessment interface 11 and displays the most recently performed assessment attempt. A reset lesson button 127, and an open in digital audio workstation button 128 can also be displayed in assessment results view 120. When clicked, open in digital audio workstation button 128 can prompt the system to open the current lesson in a digital audio workstation. When clicked, reset lesson button 127 can prompt a complete reset of the lesson. A complete reset can include erasing all assessment related data created by the user along with general settings, like the user's position within the lesson, view settings, user recordings, and mixer signals. The complete reset can reset both the High Score and Progress displays and erase all the user's recordings for the lesson. The result of a complete reset can be the same as starting the lesson for the very first time.

Figure 13:
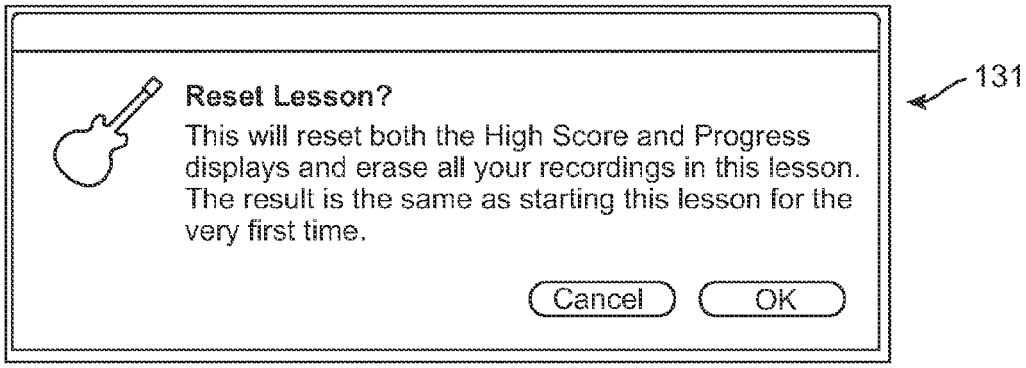
FIG. 13 depicts a schematic view of a dialog box.

Referring to FIG. 13, a dialog box 131 is shown. Dialog box 131 can inform the user about the consequences of completely resetting the data stored for the lesson. Dialog box 131 can be displayed automatically when reset lesson button 127 is clicked.

Referring again to FIG. 12, assessment results view 120 can also include a show progress chart button 129. When clicked progress chart button 129 can prompt the display of a progress chart.

Figure 14:
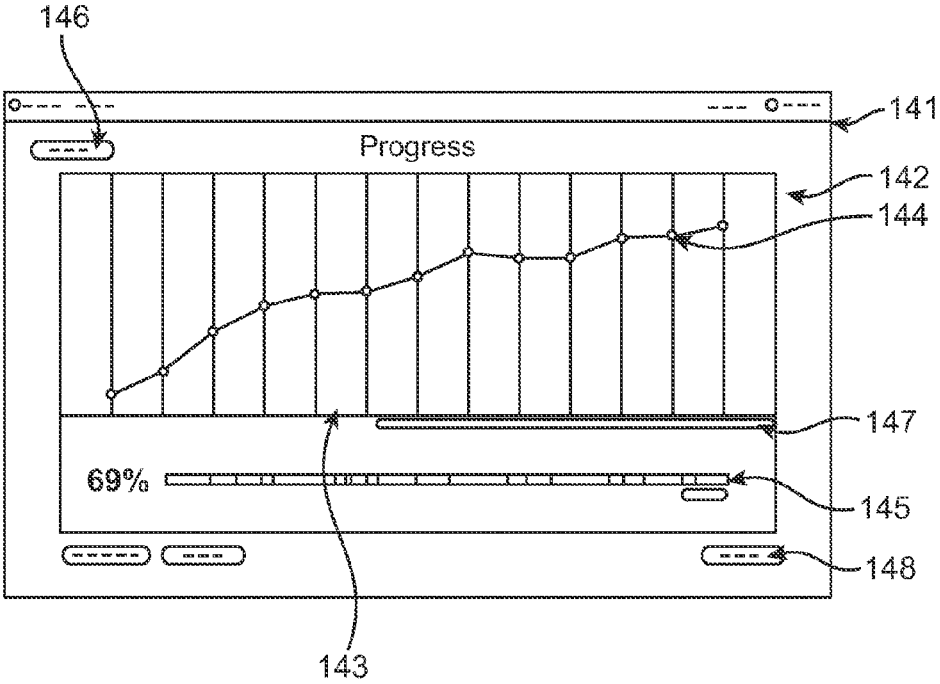
FIG. 14 depicts a schematic view of a progress chart user interface.

Referring to FIG. 14, progress chart 141 is shown. The progress chart 141 can plot the assessment result percentage 142 over time 143. Each assessment attempt 144 can be displayed as a unique point. The progress chart 141 can interpolate between assessment attempts 144. Information about the time when each assessment attempt was produced can also be displayed or outlined on or near the chart. Each attempt 144 can be selectable. When a user selects an attempt 144, for example, by double-clicking it, an assessment strip 145 for the selected attempt 144 can be displayed near the chart. By default, an assessment strip 145 for the most recent assessment attempt 144 can be displayed. A back to high scores button 146 can be displayed near the chart to allow a user to navigate back to the assessment results view 120. In cases where there are more assessment attempts than can fit on the screen horizontally, a horizontal scrollbar 147 can be provided. Scrollbar 147 can allow a user to scroll through time 143 to view attempts 144 that do not fit on the screen. An email results button 148 can be provided to allow the user to send his or her results via email. An affordance can call up mail, a new email can be created, and an HTML version of the overall chart 141 and the list 121 can be inserted into the body of the email.

Figure 15:
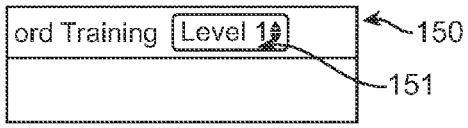
FIG. 15 depicts a schematic of a portion of a chord trainer user interface.
Figure 16:
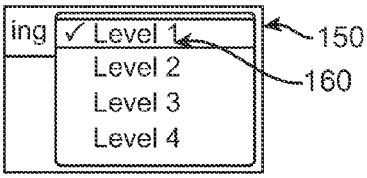
FIG. 16 depicts a schematic of a dropdown menu for selecting a chord training level.

Referring to FIG. 15, a schematic of a portion 150 of a chord trainer user interface 11 is shown. The portion 150 includes a level selector 151. Referring to FIG. 16, a schematic of a dropdown menu 160 within a portion 150 of user interface 11. A user can use dropdown menu 160 to select a chord training level. Chords can be grouped in levels. Levels can be distinguished on any basis, for example, skill level, musical context, etc. Levels can also be based on a stored success rating for each particular chord. For example, chords that a user plays correctly 50% of the time can be grouped in a separate level than chords that a user plays correctly 100% of the time. The success ratings for each chord can be collected during assessments for any lesson. A user's performance in any lesson in which a particular chord appears can contribute to the overall success rating for that chord. The chords within one level can have a fixed order. The user can practice chords one after another in the fixed order. The chord trainer user interface compares the chord to be played with an input signal, for example, a MIDI input signal or an audio signal. The input signal represents a chord actually played by the user on an instrument. If the chord actually played matches the chord to be played, then the chord trainer user interface can advance to the next chord in the fixed order. The user can also jump to specific chords manually, for example, by clicking on a chord.

Figure 17:
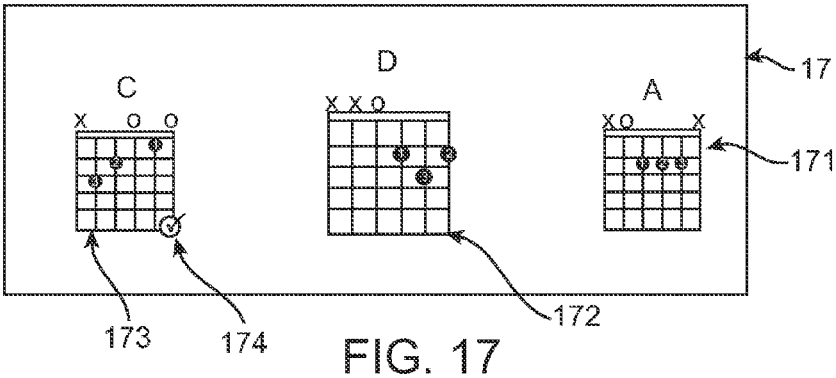
FIG. 17 depicts a schematic of a chord display region in a chord trainer user interface.

Referring to FIG. 17, a schematic of a chord display region 17 within a chord trainer user interface 11 is shown. Chord display region 17 can include a series of chords. The series of chords can include a single chord or multiple chords. The series of chords can include 3 chords. The series of chords can include previous chord 173, current chord 172, and next chord 171. Chords can be displayed for any instrument. The chords can be graphical depictions of guitar chords, such as chord grids. The chord grids can include alphanumeric designations of the chord name and/or symbolic representations of the chord name. The chords can also be standard musical notation of piano chords, as shown in chord display region 17, in FIG. 1. Previous chord 173 can include a chord rating 174 indicating whether the chord was played correctly. In some embodiments, if the user plays current chord 172 correctly, the series of chords shifts to the left so that previous chord 173 is replaced by current chord 172, current chord 172 is replaced by next chord 171, and next chord 171 is replaced by a chord from the fixed order or with a chord from the chord library. In other embodiments, the chords shift regardless of whether the user plays the chords correctly. A shift simply occurs each time the user plays a chord.

Figure 18:
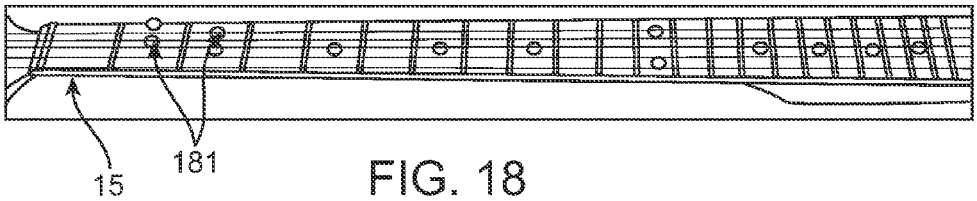
FIG. 18 depicts a schematic of an instrument region in a chord trainer user interface.

Referring to FIG. 18, a schematic of an instrument region 15 in a chord trainer user interface is shown. The instrument region 15 can display any portion of any instrument. For example, a guitar fretboard or piano keyboard can be displayed. The fingering for the current chord 172 can be illustrated on the instrument displayed in the instrument region 15. For example, finger position indicators 181 can be displayed on a guitar fretboard. Similar finger position indicators can be displayed on a piano keyboard. The finger position indicators can also be annotated with alphanumeric or symbolic indicators to communicate how to play the depicted chord. For example, the alphanumeric or symbolic indicators can include fingering numbers designating which fingers should be used to play the depicted chord.

Figure 19:
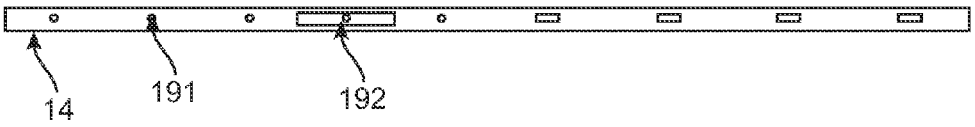
FIG. 19 depicts a schematic of a chord lane region in a chord trainer user interface.

Referring to FIG. 19, a schematic of a chord lane region 14 in user interface 11 is shown. Chord lane region 14 can be shown in the lower area of the user interface 11. The chord lane region 14 can be a narrow horizontal strip, divided into chord segments 191. Each chord segment 191 can represent one or more chords in the current level. The chord segments can be shown in order from left to right. A current chord segment 192 can be shaded. For example, the current chord segment can be highlighted. The current chord segment 192 can represent the currently active chord and remain positioned in the center of the chord lane region 14. By keeping the current chord segment 192 positioned in the center of the chord lane region 14, no playhead or timeline needs to be shown. Only the selection of chords will progress with the current selected chord in the chord trainer user interface. The chord segments 191 can be clicked to jump directly to another chord. Upon clicking a chord segment 191, the chord trainer user interface will display the selected chord.

Figure 20:
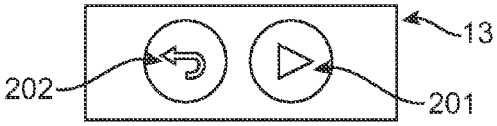
FIG. 20 depicts a schematic of a control region in a chord trainer user interface.

Referring to FIGS. 20 and 17, a schematic of a control region 13 in a chord trainer user interface 11 is shown. Control region 13 can include a play button 201 and a restart button 202. If play button 201 is enabled, embodiments can wait for the user to play the current chord 172 correctly. If the user succeeds in playing the current chord 172, current chord 172 can be shaded or highlighted, for example, in green, to indicate that the chord was played correctly. Simultaneously, the chords can move one slot to the left to bring in a new chord to be played. If the play button 201 is disabled and the user plays current chord 172, then playback can automatically be enabled. If play button 201 is enabled and the user selects a different chord or a different chord level, then playback can be disabled automatically. A separate reset button 202 can allow the user to move quickly to the beginning of the current chord training level.

Figure 21:
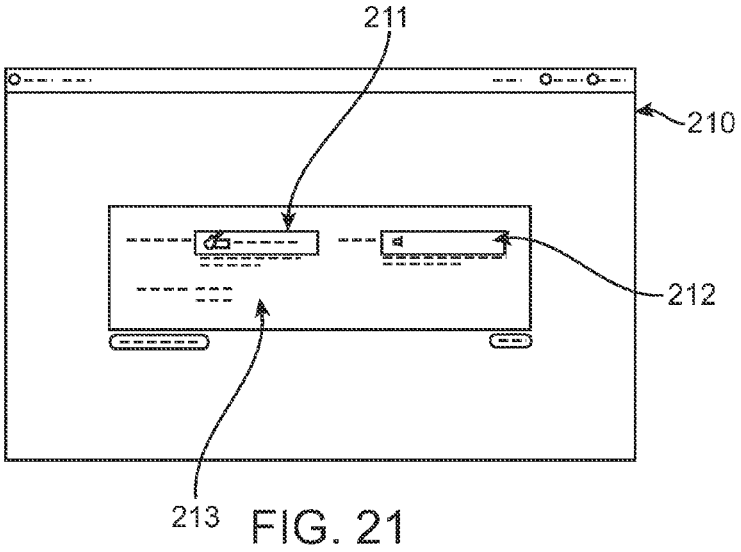
FIG. 21 depicts a schematic of a chord trainer setup page.

Referring to FIG. 21, a schematic of a chord trainer setup page 210 is shown. Chord trainer setup page 210 can include input settings 211, monitor settings 212, and instrument region orientation settings 213. Input settings 211 can allow a user to select a type of instrument to provide input. Monitor settings 212 can allow a user to specify whether an audio output signal should be sent to an audio output device to allow the user to monitor the inputted signal. Instrument region orientation settings 213 can allow a user to select an angle at which the instrument in the instrument region will be displayed. For example, the orientation of a guitar fretboard can be specified.

A database of glossary subjects can be stored in memory, according to various embodiments. Glossary subjects can offer the user topics or training that are valid for several or all lessons. Glossary subjects can be a global area, independent from any specific lesson. The glossary subjects can help improve skills and can offer knowledge about topics that are on a more general level than the specifics of a lesson. For example, information on core playing techniques or chord training can be provided as glossary subjects. Glossary subjects can include video, pictures, and text. Glossary subjects can be authored as HTML files that can be displayed by a digital audio workstation as a web view. The content for the lessons stored as glossary subjects can be streamed from a server or stored on a local device.

Topics from within the glossary subject database can be offered to a user interactively during the course of a lesson. Topics can be linked to the parts of a lesson, where they are most relevant. For example, in a lesson that includes a score requiring the user to play a glissando, i.e., a glide from one pitch to another, a glossary subject topic on techniques for executing a glissando could be suggested from within the user interface 11 or in the chord trainer user interface. Glossary subjects can also be provided using a static, as opposed to an interactive, approach. A new button in the top row of the user interface can be provided to switch the user interface to a glossary interface. When the new button is selected, the area below the top bar can display a web view, including pre-produced HTML files. The first page can offer the top navigation level through the glossary subjects. The navigation can have any number of levels. For example, the glossary can have up to three levels. On the lowest level, the user can select the single subjects.

Figure 22:
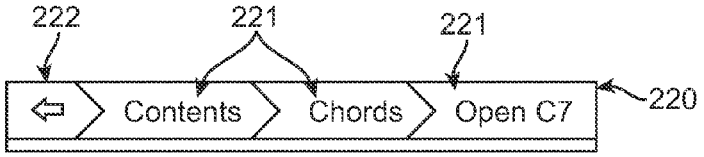
FIG. 22 depicts a schematic of a glossary navigation bar.

Referring to FIG. 22, a glossary navigation bar 220 is shown. Glossary navigation bar 220 can include various hierarchy level tabs 221 and a back button 222. By clicking on the hierarchy level tabs 221, the user can jump back to higher levels of the navigation. Back button 222 can allow the user to switch back to the previous lesson.

The glossary subjects can be single, isolated topics that can be global to the current lesson. For example, glossary subjects can include topics such as "holding a pick," or "note names on staff." The glossary subjects can be selected in HTML navigation. The glossary topics can be presented as still graphics, including text and graphic charts, and/or as video. If the glossary topic includes video, video navigation controls can be provided as well as a volume control.

Figure 23:
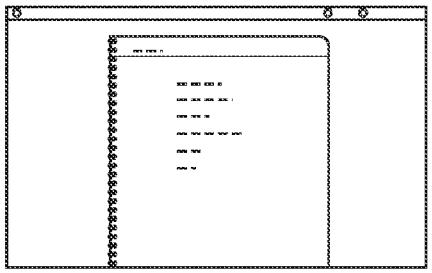
FIGS. 23-26 depict schematic views of glossary subject pages.

Referring to FIG. 23, an example of a glossary topic page is shown, depicting a top level HTML navigation of various other glossary subjects. The HTML navigation can include hyperlinks to other glossary subject pages.

Figure 24:
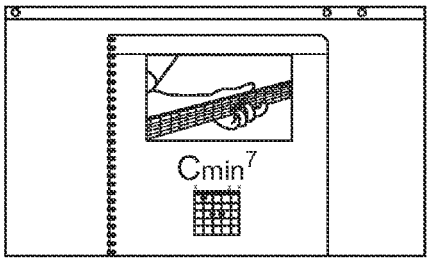

Referring to FIG. 24, an example of a glossary topic page is shown, depicting a movie and a graphic. The graphic is a guitar chord grid. The movie can provide a demonstration of how to form the chord grid on a guitar fretboard, as well as the sound produced by playing the chord depicted in the chord grid.

Figure 25:
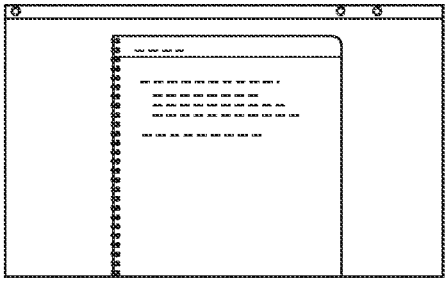

Referring to FIG. 25, an example of a glossary topic page is shown, depicting explanatory or education text with links to other glossary subject pages and/or to pages on the world wide web.

Figure 26:
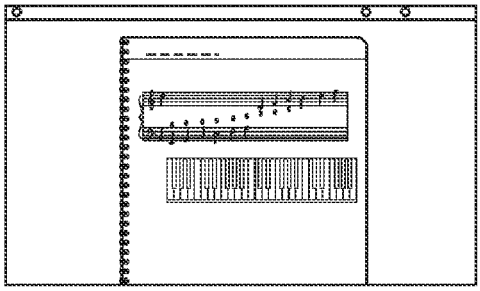

Referring to FIG. 26, an example of a glossary topic page is shown, depicting a graphic. The graphic can show a musical score and a piano keyboard, illustrating the positions of the notes of the musical score. The graphic can be animated to advance through the score. The piano keyboard can also be animated, and can be shown to play along with the musical score.

According to some embodiments, ornamentations can be displayed in the notation area. For example, ornamentations can be displayed in chord display region 17, as illustrated in FIG. 1, or in any other display area that includes musical notations, such as musical ledgers, chord grids, or guitar tablatures. Ornamentations can also be authorable by the user.

Figure 27:
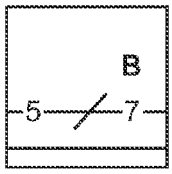
FIGS. 27-46 depict illustrations of various musical ornamentations.

Referring to FIG. 27, an illustration of a guitar tablature ornamentation is shown, the ornamentation indicates a bend. Bends can include an indication of how far to bend the note. For example, ¼ step, ½ step, or a whole step.

Figure 28:
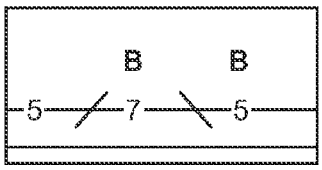

Referring to FIG. 28, an illustration of a guitar tablature ornamentation is shown, the ornamentation indicates a pre-bend and a release bend. The pre-bend can indicate how far to prebend.

Figure 29:
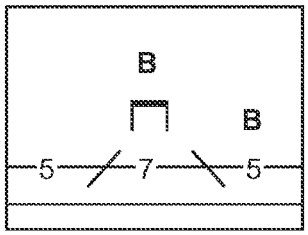

Referring to FIG. 29, an illustration of a guitar tablature ornamentation is shown, the ornamentation indicates a bend up in pitch, following a striking of the note, then a bend back down to the original note.

Figure 30:
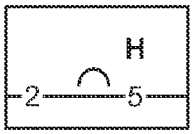

Referring to FIG. 30, an illustration of a guitar tablature ornamentation is shown, the ornamentation indicates a hammer-on.

Figure 31:
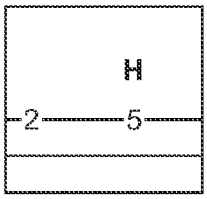

Referring to FIG. 31, an illustration of a guitar tablature ornamentation is shown, the ornamentation indicates a hammer-on.

Figure 32:
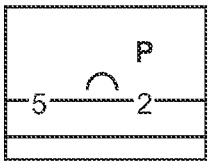

Referring to FIG. 32, an illustration of a guitar tablature ornamentation is shown, the ornamentation indicates a pull-off.

Figure 33:
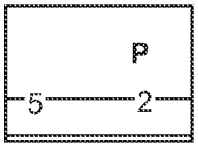

Referring to FIG. 33, an illustration of a guitar tablature ornamentation is shown, the ornamentation indicates a pull-off.

Figure 34:
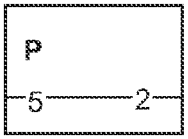

Referring to FIG. 34, an illustration of a guitar tablature ornamentation is shown, the ornamentation indicates a pull-off.

Figure 35:
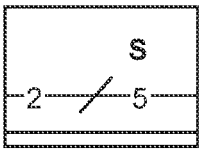

Referring to FIG. 35, an illustration of a guitar tablature ornamentation is shown, the ornamentation indicates a slide up to a note.

Figure 36:
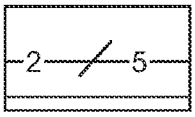

Referring to FIG. 36, an illustration of a guitar tablature ornamentation is shown, the ornamentation indicates a slide up to a note.

Figure 37:
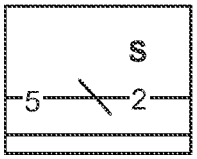

Referring to FIG. 37, an illustration of a guitar tablature ornamentation is shown, the ornamentation indicates a slide down to a note.

Figure 38:
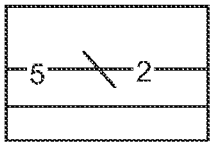

Referring to FIG. 38, an illustration of a guitar tablature ornamentation is shown, the ornamentation indicates a slide down to a note.

Figure 39:
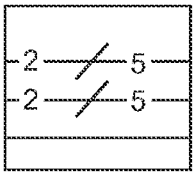

Referring to FIG. 39, an illustration of a guitar tablature ornamentation is shown, the ornamentation indicates a slide between two notes.

Figure 40:
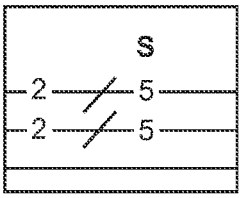

Referring to FIG. 40, an illustration of a guitar tablature ornamentation is shown, the ornamentation indicates a slide between two notes.

Figure 41:
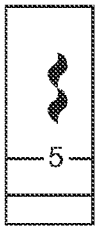

Referring to FIG. 41, an illustration of a guitar tablature ornamentation is shown, the ornamentation indicates a note played with vibrato.

Figure 42:
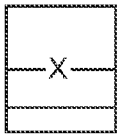

Referring to FIG. 42, an illustration of a guitar tablature ornamentation is shown, the ornamentation indicates a dead strum or muted note. An "x" rather than an actual note head, can indicate a dead strum or muted note.

Figure 43:
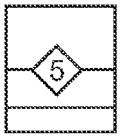

Referring to FIG. 43, an illustration of a guitar tablature ornamentation is shown, the ornamentation indicates a harmonic note.

Any other desirable ornamentation can be displayed. For example, pinch harmonics, grace notes, trills, and whammy bar up and down can also be indicated with ornamentations.

Left-handed individuals often restring guitars so that the left-hand strums the strings and the right-hand depresses the strings along the fretboard. Notation for the right hand can be added to lessons. Right hand notation can be shown in the notation alone or in both the notation and on the fretboard.

Figure 44:
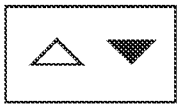

Referring to FIG. 44, an illustration of guitar tablature ornamentations are shown, the ornamentations indicate the directing of picking or strumming guitar strings. Guitar strings can be strummed up or down.

Figure 45:
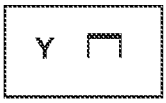

Referring to FIG. 45, an illustration of guitar tablature ornamentations are shown, the ornamentations indicate the directing of picking or strumming guitar strings.

Figure 46:
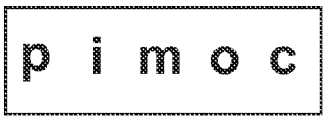

Fingerpicking is a technique for playing a stringed instrument, such as a guitar. The fingers can pluck upward into the hand and the thumb can pluck downward. The fingers and the thumb can strum in both directions. Referring to FIG. 46, an illustration of a guitar tablature ornamentation is shown, the ornamentation indicates symbols for fingerpicking. The symbols refer to Spanish words. The thumb is indicated by the letter, "p," which stands for "pulgar." The index finger is indicated by the letter, "i," which stands for "indio." The middle finger is indicated by the letter, "m," which stands for "medio." The ring finger is indicated by the letter, "a," which stands for "anular." The pinkie is indicated by the letter, "c," which stands for "chiquita."

Figure 47:
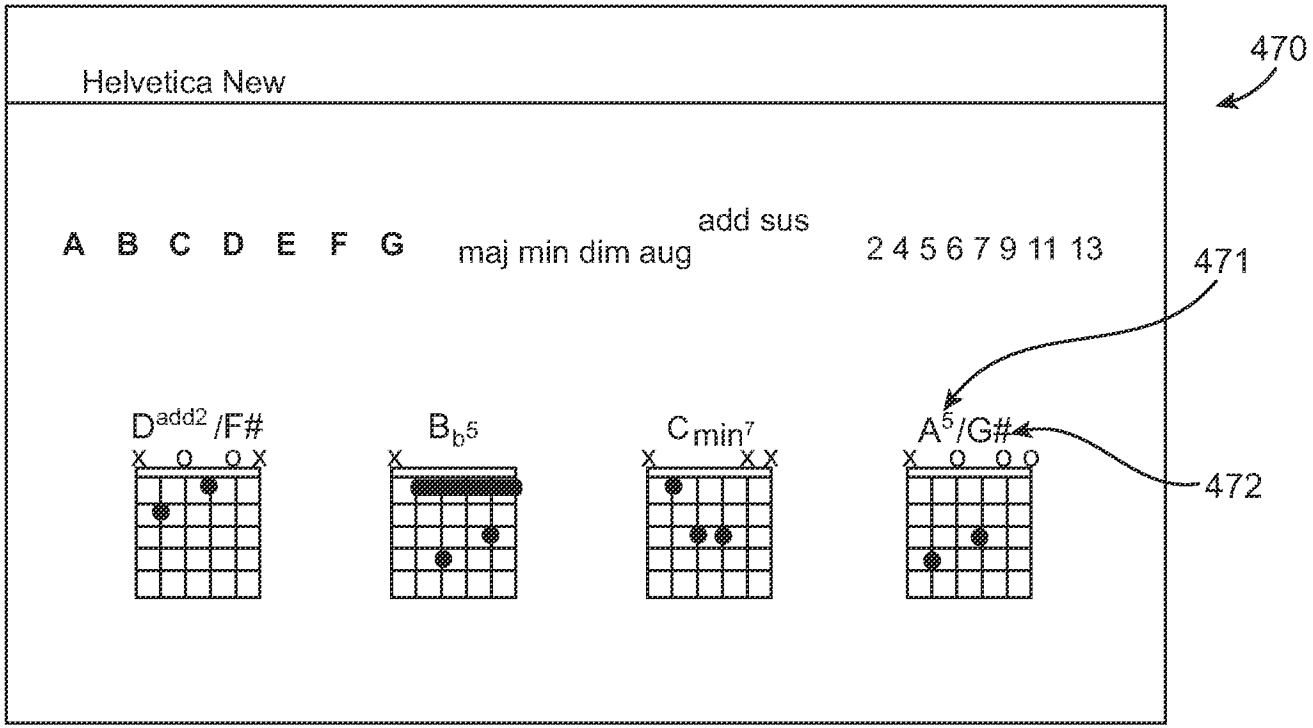
FIG. 47 illustrates chord grid styles and fonts.

Fonts used in the notation can be set with a default style. For example, "Helvetica New" can be used as a default font. Referring to FIG. 47, an illustration 470 of chord grid styles and fonts is shown. Chord grids can be annotated with symbolic representations of the chords. For example, alphanumeric chord names can be assigned. A symbol for the main chord 471, illustrated in the chord grid can be shown. A symbol for a base chord 472 can also be shown. Base notes or chords 472 can be on the same level as the main chord 471. The main chord and the base chord can be separated by a slash. The fonts can be adjusted.

Figure 48:
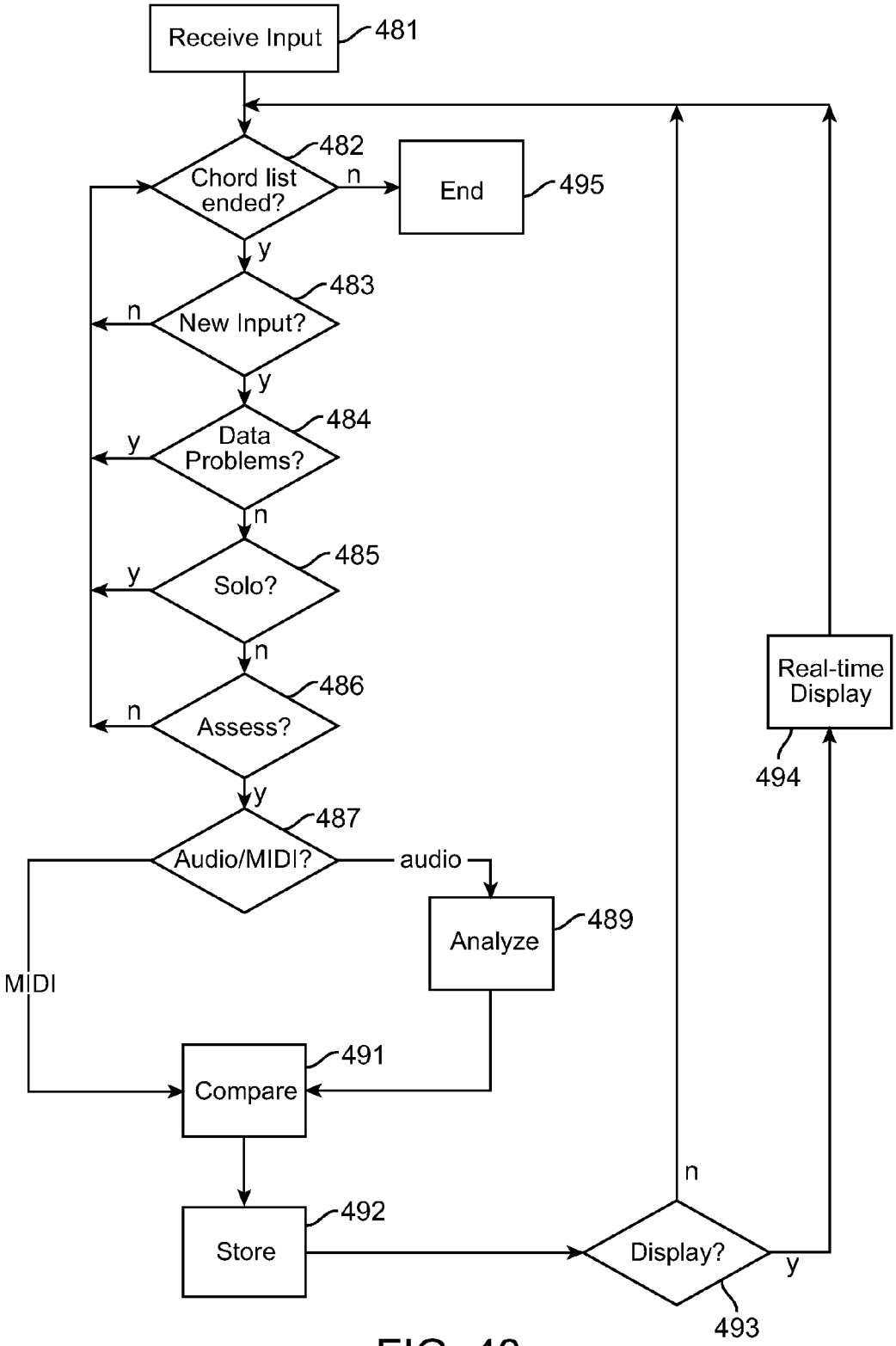
FIG. 48 depicts a flowchart, illustrating various embodiments.

Referring to FIG. 48, a flow chart is shown, illustrating various embodiments. An input can be compared in real-time with a score and/or with a track, and assessment results can be obtained. An input can be received at box 481. A determination can be made at box 482 as to whether the chord list or progression has ended at the time the input is received. If the chord list or progression has already ended, the assessment can end at box 495. If the musical score or track has not already ended when the input is received, a determination can be made at box 483 as to whether the input is a new input. If the input has already been evaluated, it is not a new input, and another determination can be made at box 482 for any subsequent inputs. If the input has not been evaluated, it is a new input, and a determination can be made at box 484 as to whether any data discrepancies exist between the musical score and the musical track. If the stored chord, chord series, or chord progression does not match the musical track, then a data discrepancy exists, and another determination can be made at box 482 for any subsequent inputs. If the stored chord, chord series, or chord progression matches the musical track, then a data discrepancy does not exist and a determination can be made at box 485 as to whether the musical score or musical track specifies a solo at the moment the input is received. If only the musical track, stored chord, chord series, or chord progression is available, then a data discrepancy does not exist and a determination can be made at box 485 as to whether the musical score or musical track specifies a solo at the moment the input is received. If the track, stored chord, chord series, or chord progression specifies a solo, another determination can be made at box 482 for any subsequent inputs. If the track, stored chord, chord series, or chord progression does not specify a solo, a determination can be made at box 486 as to whether the user desires the input to be assessed. If the user has indicated that the input should not be assessed, another determination can be made at box 482 for any subsequent inputs. If the user has indicated that the input should be assessed, a determination can be made at box 487 as to whether the input is an audio signal or a MIDI signal. If the input is an audio signal, then the audio signal can be analyzed at box 489. After the audio signal is analyzed at box 489, it can be compared with the musical track, stored chord, chord series, and/or chord progression at box 491. If the input is a MIDI signal, it can be compared with the musical track, stored chord, chord series, and/or chord progression at box 491 without any analysis. After the input has been compared to the musical track, stored chord, chord series, and/or chord progression, the results of the comparison can be stored, for example, in memory at box 492. After the results are stored, a determination can be made at box 493 as to whether the user desires the results to be displayed. If the user desires the results to be displayed, the results can be displayed in real-time at box 494. After the results are displayed at box 494, another determination can be made at box 482 for any subsequent inputs. If the user does not want the results to be displayed, another determination can be made at box 482 for any subsequent inputs.

This disclosure includes flowcharts, however the flowcharts are not to be construed as requiring a particular order for the activities shown therein, or that all activities must or should be present in a particular embodiment, or that other activities cannot be added. Further, such activities need not necessarily be discretized in the way shown by these examples, but rather such activities can be implemented in more or fewer actions, or equivalents of such activities can be implemented in some embodiments.

Isolation of one flowchart from another or isolation of elements within a flowchart does not require or imply that these methods would execute in isolation, but rather in implementations, code according to such flowcharts can be implemented to cooperate, and in some cases, such code can use or rely on services and functions centrally provided, such as by an operating system. As such, these flowcharts do not imply the existence of discrete functional or code modules for methods according to these examples.

The technology can take the form of an entirely hardware embodiment, an entirely software embodiment or an embodiment containing both hardware and software elements. In one embodiment, the invention is implemented in software, which includes but is not limited to firmware, resident software, microcode, etc. Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD. Both processors and program code for implementing each as aspect of the technology can be centralized and/or distributed as known to those skilled in the art.

The above disclosure provides examples and aspects relating to various embodiments within the scope of claims, appended hereto or later added in accordance with applicable law. However, these examples are not limiting as to how any disclosed aspect may be implemented, as those of ordinary skill can apply these disclosures to particular situations in a variety of ways.

Although the present invention has been described in considerable detail with reference to certain preferred versions thereof, other versions are possible. Therefore, the spirit and scope of the appended claims should not be limited to the description of the preferred versions contained herein.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, sixth paragraph. In particular, the use of "step of" in the claims herein is not intended to invoke the provisions of 35 U.S.C. §112, sixth paragraph.

We claim:

1. A method for assessing a musical performance, the method comprising:

displaying a first graphical depiction of a sequence of chords including a first chord and a second chord;

displaying a second graphical depiction of a musical instrument that is different than the first graphical depiction, wherein fingering positions for said sequence of chords are indicated on said second graphical depiction;

receiving a first input corresponding to said first chord played by a user in correlation with said first chord displayed in said sequence of chords;

comparing the first input to notes of said first chord in said sequence;

displaying a first result of said comparing;

in response to said first chord being played correctly by said user, advancing the sequence of chords;

receiving a second input corresponding to said second chord played by said user in correlation with said second chord displayed in said sequence of chords;

comparing a second input to notes of said second chord in said sequence; and displaying a second result of said comparing.

2. The method according to claim 1, further comprising displaying assessment results for one or more recent performances, the assessment results including a timeline for each performance, each timeline indicating one or more positions in which the percentage of correct notes was below a predetermined threshold, and wherein the user can select one of the positions and re-perform notes of the selected position.

3. The method according to claim 1, wherein the first or second input is a polyphonic audio signal and individual notes within the polyphonic audio signal are identified using spectral analysis prior to comparing the first or second input to the sequence of chords.

4. The method according to claim 1, further comprising displaying a pitch error, timing error, or both for any incorrectly played notes.

5. The method of claim 1, wherein the first and second displayed results of comparing comprises a real-time performance rating icon, the icon indicating a percentage substantially equal to a percentage of correct notes within a predetermined time frame.

6. A system comprising:

a processor;

a display device;

a first module configured to control the processor to display on said display device a first graphical depiction of a sequence of chords including a first chord and a second chord;

a second module configured to control the processor to display on said display device a second graphical depiction of a musical instrument that is different than the first graphical depiction, wherein fingering positions for said sequence of chords are indicated on said second graphical depiction;

a third module configured to control the processor to compare a received first input corresponding to notes of said first chord played in correlation with said first chord in displayed sequence of chords, determining that said first chord was played correctly by said user, advancing the sequence of chords; receiving a second input corresponding to said second chord played by said user in correlation with said second chord in said displayed sequence of chords; comparing said received second input to notes of said second chord in said sequence; and a fourth module configured to control the processor to display on said display device a result of the comparing by the processor in accordance with said third module.

7. The system according to claim 6, further comprising a fifth module configured to control the processor to display assessment results for one or more recent performances, the assessment results including a timeline for each performance, each timeline indicating one or more positions in which the percentage of correct notes was below a predetermined threshold, and wherein the user can select one of the positions and re-perform notes of the selected position.

8. The system according to claim 6, wherein the received first or second input is a polyphonic audio signal and individual notes within the polyphonic audio signal are identified using spectral analysis prior to comparing the first or second input to the sequence of chords.

9. The system according to claim 7, further comprising a sixth module to display a pitch error, timing error, or both for any incorrectly played notes of said sequence of chords.

10. The system according to claim 6, wherein the received first or second input includes MIDI data.

11. The system of claim 6, wherein the first and second displayed results of comparing comprises a real-time performance rating icon, the icon indicating a percentage substantially equal to a percentage of correct notes within a predetermined time frame.

12. A non-transitory computer-readable storage medium storing instructions which, when executed by a computing device, cause the computing device to assess a musical performance, the instructions comprising:

displaying a first graphical depiction of a sequence of chords including a first chord and a second chord;

displaying a second graphical depiction of a musical instrument that is different than the first graphical depiction, wherein fingering positions for said sequence of chords are indicated on said second graphical depiction;

receiving a first input corresponding to said first chord played by a user in correlation with said first chord displayed in said sequence of chords;

comparing the first input to notes of said first chord in said sequence;

displaying a first result of said comparing;

in response to said first chord being played correctly by said user, advancing the sequence of chords;

receiving a second input corresponding to said second chord played by said user in correlation with said second chord displayed in said sequence of chords;

comparing a second input to notes of said second chord in said sequence; and displaying a second result of said comparing.

13. The non-transitory computer-readable storage medium of claim 12, the instructions further comprising displaying assessment results for one or more recent performances, the assessment results including a timeline for each performance, each timeline indicating one or more positions in which the percentage of correct notes was below a predetermined threshold, and wherein the user can select one of the positions and re-perform notes of the selected position.

14. The non-transitory computer-readable storage medium of claim 12, wherein the first or second input is a polyphonic audio signal and individual notes within the polyphonic audio signal are identified using spectral analysis prior to comparing the first or second input to the sequence of chords.

15. The non-transitory computer-readable storage medium of claim 12, the instructions further comprising displaying a pitch error, timing error, or both for any incorrectly played notes.

16. The non-transitory computer-readable storage medium of claim 12, wherein the first and second displayed results of comparing comprises a real-time performance rating icon, the icon indicating a percentage substantially equal to a percentage of correct notes within a pre-determined time frame.

* * * * *